US010584907B2

(12) United States Patent
Laible et al.

(10) Patent No.: US 10,584,907 B2
(45) Date of Patent: Mar. 10, 2020

(54) DOMESTIC REFRIGERATION APPLIANCE WITH A CONTROL UNIT FOR SPECIFIC CONTROL OF AN ICE AND/OR WATER-DISPENSING DEVICE AND METHOD FOR OPERATING SUCH A DOMESTIC REFRIGERATION APPLIANCE

(71) Applicant: BSH HAUSGERAETE GMBH, Munich (DE)

(72) Inventors: Karl-Friedrich Laible, Langenau (DE); Hans Gerd Keller, Giengen (DE)

(73) Assignee: BSH Hausgeraete GmbH, Munich (DE)

( * ) Notice: Subject to any disclaimer, the term of this patent is extended or adjusted under 35 U.S.C. 154(b) by 393 days.

(21) Appl. No.: 14/961,114

(22) Filed: Dec. 7, 2015

(65) Prior Publication Data

US 2016/0161169 A1 Jun. 9, 2016

(30) Foreign Application Priority Data

Dec. 8, 2014 (DE) ..... 10 2014 225 087

(51) Int. Cl.
*F25C 5/00* (2018.01)
*F25C 5/04* (2006.01)
(Continued)

(52) U.S. Cl.
CPC ..... *F25C 5/046* (2013.01); *F25C 5/22* (2018.01); *F25D 23/126* (2013.01); *F25C 2400/08* (2013.01); *F25C 2600/04* (2013.01)

(58) Field of Classification Search
CPC .. F25C 2400/08; F25C 2600/04; F25C 5/046; F25C 5/12; F25C 5/02; F25C 5/22
See application file for complete search history.

(56) References Cited

U.S. PATENT DOCUMENTS 5,056,688 A * 10/1991 Goetz ..... F25C 5/046 222/146.6
7,006,892 B2 2/2006 Jeong
(Continued)

FOREIGN PATENT DOCUMENTS

DE 102007048573 A1 4/2009
DE 20321896 U1 5/2012

*Primary Examiner* — Filip Zec
(74) *Attorney, Agent, or Firm* — Laurence A. Greenberg; Werner H. Stemer; Ralph E. Locher

(57) ABSTRACT

A domestic refrigeration appliance includes an ice and/or water-dispensing device for non-crushed ice pieces or ice flakes created therefrom by crushing or water created in the appliance, depending on an operational setting of a medium creation facility. The dispensing device has a user-actuatable dispensing lever movable to start dispensing. An adjustment facility adjusts an operational setting of the creation facility. An input facility has user-actuated controls selecting a medium dispensing type before actuating the lever. A control unit adjusts the adjustment facility depending on a signal created by actuation of a control and associated medium dispensing type, before actuating the lever to change the operational setting of the creation facility if the creation facility coupled with the adjustment facility is positioned in an operational setting different from that required for the selected medium dispensing type. A method of operating the appliance is also provided.

12 Claims, 2 Drawing Sheets

(51) Int. Cl.
*F25C 5/20* (2018.01)
*F25D 23/12* (2006.01)

(56) References Cited

U.S. PATENT DOCUMENTS

| | | | | |
|---|---|---|---|---|
| 8,011,202 | B2 * | 9/2011 | Kim | F25C 5/22 62/344 |
| 8,959,943 | B2 * | 2/2015 | Schukar | B01F 11/0082 62/340 |
| 10,036,586 | B2 * | 7/2018 | Yang | F25C 5/182 |
| 2003/0019236 | A1 * | 1/2003 | Heims | B67D 3/0009 62/338 |
| 2007/0163285 | A1 * | 7/2007 | An | F25C 5/12 62/344 |
| 2007/0199407 | A1 * | 8/2007 | Ramirez | F16H 1/203 74/665 L |
| 2008/0156005 | A1 * | 7/2008 | Culley | F25C 5/22 62/132 |
| 2008/0228318 | A1 * | 9/2008 | Roo | F25C 5/005 700/231 |
| 2010/0204832 | A1 * | 8/2010 | Choi | F25C 5/005 700/275 |
| 2010/0251740 | A1 | 10/2010 | Schmidt et al. | |

* cited by examiner

DOMESTIC REFRIGERATION APPLIANCE WITH A CONTROL UNIT FOR SPECIFIC CONTROL OF AN ICE AND/OR WATER-DISPENSING DEVICE AND METHOD FOR OPERATING SUCH A DOMESTIC REFRIGERATION APPLIANCE

CROSS-REFERENCE TO RELATED APPLICATION

This application claims the priority, under 35 U.S.C. § 119, of German Application DE 10 2014 225 087.0, filed Dec. 8, 2014; the prior application is herewith incorporated by reference in its entirety.

BACKGROUND OF THE INVENTION

Field of the Invention

The invention relates to a domestic refrigeration appliance with an ice and/or water-dispensing device which is configured for dispensing pieces of ice created and crushed in the domestic refrigeration appliance or ice flakes created from the pieces of ice by crushing, or water, depending on an operational setting of a medium creation facility. The ice and/or water-dispensing device has a dispensing lever able to be operated by a user, through the movement of which the dispensing of the pieces of ice or of the ice flakes or of the water is started. The domestic refrigeration appliance also includes an adjustment facility, with which the operational setting of the medium creation facility is able to be adjusted. An input facility of the domestic refrigeration appliance includes a number of controls able to be actuated by the user, wherein the controls are embodied in each case for selection of a specific type of dispensing of the medium to be dispensed and thus for dispensing of pieces of ice or of ice flakes or of water, before the actuation of the dispensing lever. In addition, the domestic refrigeration appliance includes a control unit with which the adjustment facility is able to be operated. Furthermore, the invention also relates to a method for the operation of a domestic refrigeration appliance.

A domestic refrigeration appliance having an ice dispenser with an ice crushing facility is known from German Application DE 10 2007 048 573 A1, corresponding to U.S. Patent Application US 2010/0251740 A1.

In addition a refrigerator which is embodied with a dispenser unit for dispensing pieces of ice is known from German Utility Model DE 20 321 896 U1, corresponding to U.S. Pat. No. 7,006,892 B2.

In precisely those domestic refrigeration appliances in which such a dispensing device in the form of a dispenser for optional dispensing of pieces of ice or ice flakes, which is also referred to as "crushed ice," is provided, the medium creation facility, which in that context usually then also has a plurality of blades, which then reduces the pieces of ice flowing past it in that specific operational setting and creates the ice flakes, is to be adjusted with a specific adjustment facility. If the non-crushed pieces of ice are to be dispensed, in the form of ice cubes for example, then the adjustment is necessary to the extent that those pieces of ice are then conveyed past the blades. A mechanical switchover is necessary for that adjustment, so that the pieces of ice are either conveyed past the blades of the medium creation facility or are just guided over the blades for crushing.

That mechanical switchover can be made by lifting magnets for example. Lifting magnets enable a relatively high switchover speed from one setting into the other to be achieved and the facility can be reset through a spring, for example. A disadvantage of that embodiment is to be seen in that the abrupt switchover is also connected with a relatively loud noise and then also an adverse effect on its functioning could possibly occur over the long term through hard and sudden changes of position.

In addition, it is also known that that type of switchover can be performed by a motor. That is significantly less noisy than the embodiment with a lifting magnet and is favored in that regard. However, with that embodiment, with a motor as a switchover unit, the time required is longer, so that a user has to allow for a longer waiting time in order to then obtain the desired type of dispensed medium. In addition, there is provision in domestic appliances which are known in that regard for the entire system to be in an idle position, in which there is thus no demand for dispensing pieces of ice or ice flakes or water, for the adjustment facility always to be in the same basic position and for that to be a result of the situation in which whole pieces of ice are effectively to be dispensed. However, the resulting disadvantage of that is that when ice flakes are to be dispensed, there is a relatively slow switchover of the adjustment facility by the motor, in order to switch the facility over from that basic position, namely that position in which pieces of ice are actually to be dispensed. It can then lead to a thoroughly inconvenient long waiting time for a user.

SUMMARY OF THE INVENTION

It is accordingly an object of the invention to provide a domestic refrigeration appliance with a control unit for specific control of an ice and/or water-dispensing device and a method for operating such a domestic refrigeration appliance, which overcome the hereinafore-mentioned disadvantages of the heretofore-known devices and methods of this general type and in which a specific medium is dispensed by an ice or water-dispensing device in accordance with demand and more quickly.

With the foregoing and other objects in view there is provided, in accordance with the invention, a domestic refrigeration appliance including an ice and/or water-dispensing device which, depending on an operational setting of a medium creation facility, is embodied for dispensing non-crushed pieces of ice created in the domestic refrigeration appliance, ice flakes created by crushing the pieces of ice, or water. The ice or water-dispensing device is embodied in this case in such a way that at least two of the medium states, namely pieces of ice, ice flakes and water, are optionally dispensed. There can also be provision for the ice and/or water dispensing unit to be embodied optionally for dispensing pieces of ice or ice flakes or optionally for dispensing pieces of ice and water or optionally for dispensing ice flakes or water or optionally for dispensing pieces of ice or ice flakes or water. The ice and/or water-dispensing device also includes a dispensing lever able to be operated by the user, through the movement of which dispensing of the pieces of ice or of the ice flakes or of water is started. In addition the domestic refrigeration appliance also includes an adjustment facility, with which the operational setting of the medium creation facility is able to be adjusted. The domestic refrigeration appliance also has an electrical input facility, which has a number of controls able to be actuated by a user. Each of the controls is embodied to select a specific type of dispensing of the medium to be dispensed, before the actuation of the dispensing lever in each case. This means for example that, when the dispensing facility is only embodied for optional dispensing of pieces of ice or ice flakes, then two controls are present, of which one can be actuated for specific selection of the pieces of ice and the other for specific selection of the ice flakes, wherein a basic selection of the desired type of medium dispensing is made by actuating such a control before the actuation of the dispensing lever. In addition the domestic refrigeration appliance includes a control unit, with which at least the adjustment facility is able to be operated, in particular is able to be electronically controlled.

A significant concept behind the invention is to be seen as the control unit being embodied so as to adjust the adjustment facility as a function of a signal created by the actuation of a specific control and the specific desired type of dispensing connected therewith, before the actuation of the dispensing lever to change the operational setting of the medium creation facility. This is done if the medium creation facility coupled to the adjustment facility is positioned in an operational setting different from the operational setting for the selected specific type of dispensing. Thus, through the invention, a domestic refrigeration appliance is provided in which, under intelligent control of the control unit, any adjustment of the medium creation facility which might be necessary is then already started when a user has actuated a control of the input facility with respect to a desired type of dispensing of a medium to be dispensed. Thus, in the invention, the period of time between the actuation of the control and then the required actuation of the dispensing lever is already being used at least to initiate any adjustment process of the medium creation facility which might be required. Through this action waiting time is greatly reduced for a user with respect to the dispensing of the medium then actually taking place, especially since the actuation of the control. No longer is this possibly required adjustment only carried out when the dispensing lever is actuated, as in the prior art, but is carried out beforehand.

Preferably there is provision for the control unit to be embodied for controlling the adjustment facility so that, once dispensing of a medium has ended, the set position of the adjustment facility remains unchanged until the next user-initiated dispensing of a medium. Thus the same idle position of the adjustment facility is not then always set automatically, as in the aforementioned prior art, but in practice the current state of the adjustment facility and thus also of the medium creation facility set during the last medium dispensing is retained.

Preferably there is provision for the medium creation facility to include an ice crushing facility, which is able to be adjusted individually in its location by the adjustment facility as a function of a required dispensing selected by actuation of a specific control for pieces of ice as the first medium type or ice flakes as the second medium type. In this connection the ice crushing facility can have one or more blades, which then crush the pieces of ice guided over the blades to ice flakes.

Preferably there is provision for a container to be embodied to receive pieces of ice created in an ice-making mold, wherein the container is disposed in the domestic refrigeration appliance so as to be able to be removed non-destructively.

In an advantageous manner there is provision for the domestic refrigeration appliance to have at least one sensor, which detects that the container is not present in its end position, so that, as a function thereof, the adjustment facility is able to be adjusted by the control unit into an installation setting, in which the putting of the container into its end position by the adjustment facility is made possible without hindrance. This is likewise a very advantageous version, since the container is thus removed and replaced very easily and smoothly, without the medium creation facility being an obstacle and thus being in the way. This enables damage to the container and/or to the medium creation facility to be avoided during removal or during reinsertion.

Preferably there is provision for the installation position to be that position in which the medium creation facility is positioned for creation of ice flakes as the second medium type.

Preferably the control unit is embodied so as to activate a pump for conveying water as the third medium type as a function of a signal created by the actuation of a specific control and of a specific dispensing type connected therewith, before the actuation of the dispensing lever. This too is a very advantageous version, since when the dispensing facility is optionally also embodied for dispensing cooled water or even warm water, likewise an already direct positional setting of the medium creation facility is effected with the actuation of the control and also the waiting time until the water is actually dispensed is greatly shortened thereby.

In a further advantageous version the control unit is embodied so as to activate a light source to illuminate a dispensing recess of the domestic refrigeration appliance surrounding the dispensing lever, as a function of a signal created by the actuation of a specific control and a specific type of dispensing connected therewith, before the actuation of the dispensing lever. In this way too, even with the first action, namely the actuation of the control, a situation which might possibly improve the visibility conditions is created and then for example the positioning of a receiving container, such as a beaker or a glass right in the dispensing recess, into which the medium to be dispensed is introduced, is made possible sooner.

In a further advantageous version there is provision for the control unit to be embodied so as to open a cover for covering the front side of a dispensing recess surrounding the dispensing lever, as a function of a signal created by the actuation of a specific control and specific type of dispensing connected therewith, before the actuation of the dispensing lever. This is connected with a reduced waiting time, with respect to accessibility to the recess or the dispensing opening respectively and placing a receiving container in the dispensing recess.

Preferably there is provision for the medium creation facility to be able to be adjusted by using a drive motor of the adjustment facility or through the facility, wherein with this drive motor the mechanical adjustment of the adjustment facility and the adjustment of the medium creation facility especially connected therewith is undertaken by a motorized system, wherein the drive motor is controlled by the control unit. Through the use of this embodiment a very low-noise adjustment is achieved. It is precisely with this embodiment that the invention is especially advantageous, since the longer waiting time associated with such motorized adjustment by comparison with other versions, for example with lifting magnets, can once again be shortened, since in accordance with the invention the adjustment is already started with the actuation of the control and not just when the dispensing lever is actuated.

Preferably there is provision for the domestic refrigeration appliance to have a container, in which a feed shaft is disposed, for receiving the pieces of ice created in an ice-making mold. Through the movement of the feed shaft the pieces of ice are able to be conveyed to an outlet opening of the container, wherein a facility of the medium creation facility for crushing the pieces of ice is disposed adjacent the outlet opening of this container. Depending on the type of medium selected, this facility for crushing pieces of ice is then located in a position in the output path of the individual pieces of ice and the pieces of ice are then, depending on this position, either crushed into ice flakes or conveyed past the ice crushing facility without being crushed.

With the objects of the invention in view, there is concomitantly provided a method for operating a domestic refrigeration appliance, in which, with an ice and/or water-dispensing device, depending on an operational setting of a medium creation facility, non-crushed pieces of ice or ice flakes created from the pieces of ice by crushing or water created with this ice and/or water-dispensing device are dispensed, wherein this can be done as different options and the medium creation facility is embodied to select at least two of these three different medium types. Dispensing of the pieces of ice or of the ice flakes or of water is started by a user-initiated movement of a dispensing lever of the ice and/or water-dispensing device. The operational setting of the medium creation facility can be adjusted in such cases according to demand with an adjustment facility. The selection of a specific type of dispensing of the medium to be dispensed and thus of whether pieces of ice or ice flakes or water are to be dispensed is made before the actuation of the dispensing lever by actuating a control of an input facility, which has a number of controls able to be actuated by a user. In addition the adjustment facility is operated, or especially controlled, by a control unit of the domestic refrigeration appliance. An important concept behind the invention is to be seen in the adjustment facility being able to be adjusted and controlled by the control unit as a function of a signal created by the actuation of a specific control and a specific type of dispensing associated therewith, before the actuation of the dispensing lever to change the operational setting of the medium creation facility, if the medium creation facility coupled to the adjustment facility, when the control is actuated, is or was positioned in a different operational setting than the operational setting required for the selected specific type of medium dispensing.

Advantageous versions of the domestic refrigeration appliance according to the invention are to be seen as advantageous versions of the method according to the invention, wherein the physical components are embodied for this purpose alone or in combination to carry out the respective method steps. In particular in this context the control unit is embodied accordingly to carry out and initiate the required control processes.

Other features which are considered as characteristic for the invention are set forth in the appended claims.

Although the invention is illustrated and described herein as embodied in a domestic refrigeration appliance with a control unit for specific control of an ice and/or water-dispensing device and a method for operating such a domestic refrigeration appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
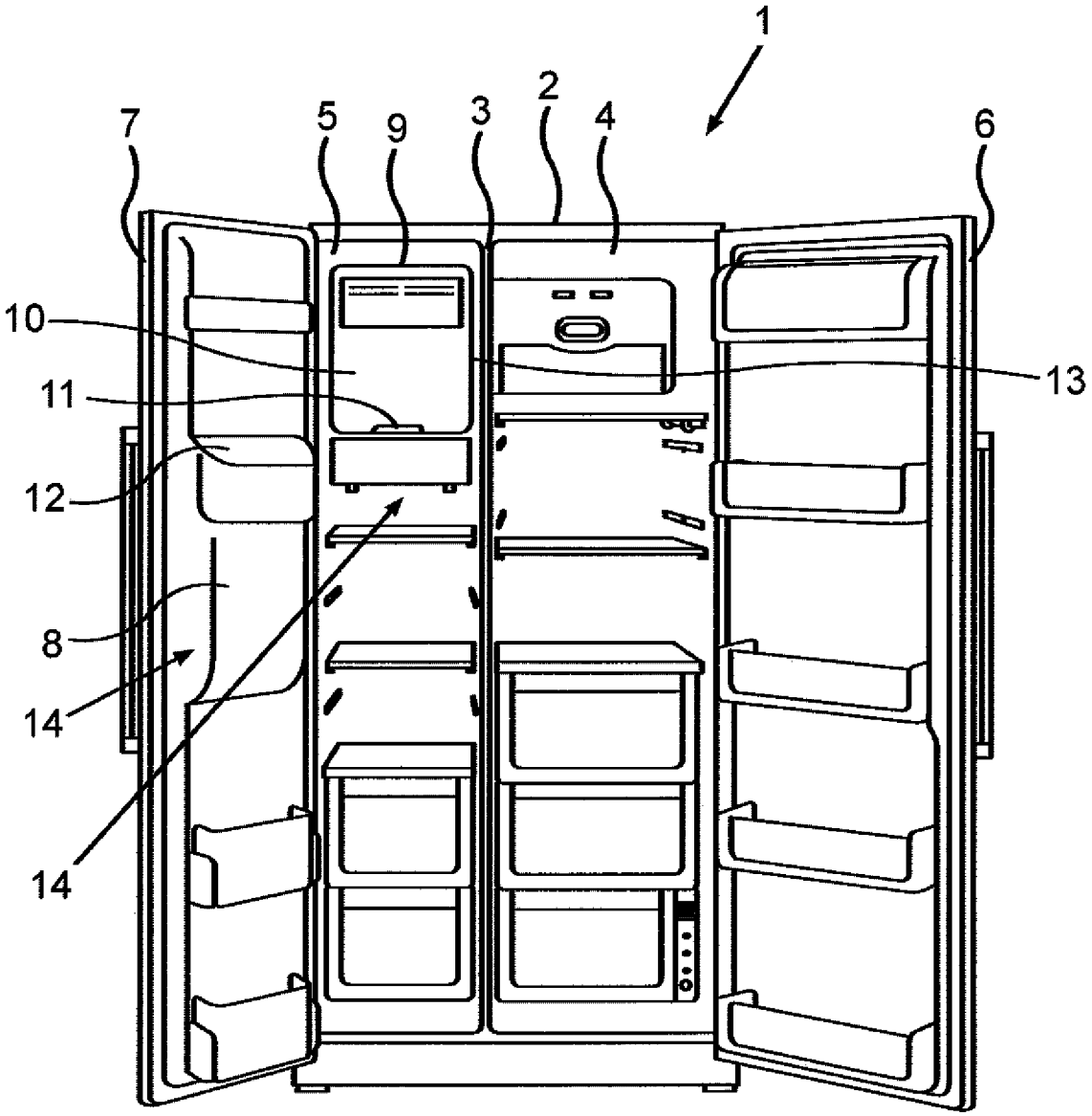
FIG. 1 is a diagrammatic, perspective view of an exemplary embodiment of a domestic refrigeration appliance according to the invention.

Referring now in detail to the figures of the drawings in which the same elements or elements with the same functions are provided with the same reference characters and first, particularly, to FIG. 1 thereof, there is seen a perspective front view of a domestic refrigeration appliance 1, which can be a refrigerator or a freezer. FIG. 1 actually shows a combination refrigerator-freezer, which has a body or a housing 2. The housing 2 of the domestic refrigeration appliance 1 additionally includes a first storage compartment 4, which is a refrigerator compartment, and a second storage compartment 5, which is a freezer compartment, that are delimited by an inner container 3. The foodstuffs introduced can be stored and conserved in the respective storage compartments 4 and 5. The first storage compartment 4 is able to be closed off by a first door 6, which is shown in FIG. 1 in the opened state. The second storage compartment 5 is able to be closed off by a hingeable second door 7 separate from the first door 6, which is likewise shown in the opened state in FIG. 1.

In the exemplary embodiment there is provision for the second door 7 to have a dispenser unit 8 of an ice and/or water-dispensing device 14. Depending on an operational setting of a medium creation facility 15, the ice and/or water-dispensing device 14 is embodied for dispensing pieces of ice, for example ice cubes, or ice flakes created from the pieces of ice by crushing or water created by the domestic refrigeration appliance 1. This means that the ice and/or water-dispensing device 14 is preferably embodied so that it can create or provide at least two of the types of media and can optionally then dispense the media. Thus the ice and/or water-dispensing device can be embodied for dispensing pieces of ice or ice flakes, which can then optionally be dispensed through individual settings and requests. There can, however, also be provision for the ice and/or water-dispensing device 14 to be embodied for optionally dispensing both the pieces of ice or the ice flakes or the water. However, with respect to the dispensing of the water, cooled water or even warm water can then be dispensed.

There is provision for the pieces of ice or ice cubes to be able to be created in an ice maker 9, which is disposed, for example, on the roof side within the freezer compartment 5, and which ejects the finished pieces of ice on an underside of the ice maker 9. To this end there is provision for these pieces of ice to be able to be introduced from above or to fall into a container 10 for intermediate storage. The ice maker 9 and the container 10 are likewise components of the ice and/or water-dispensing device 14. The pieces of ice can be conveyed as required out of the container 10 from a lower opening 11 of the container 10 directed forwards and can fall outwards through a dispensing chute 12 provided on the inside of the second door 7 on the front side of the second door 7.

There can be provision for the container 10 to be able to be released and removed from a receptacle 13 of the freezer compartment 5 without destroying it.

Figure 2:
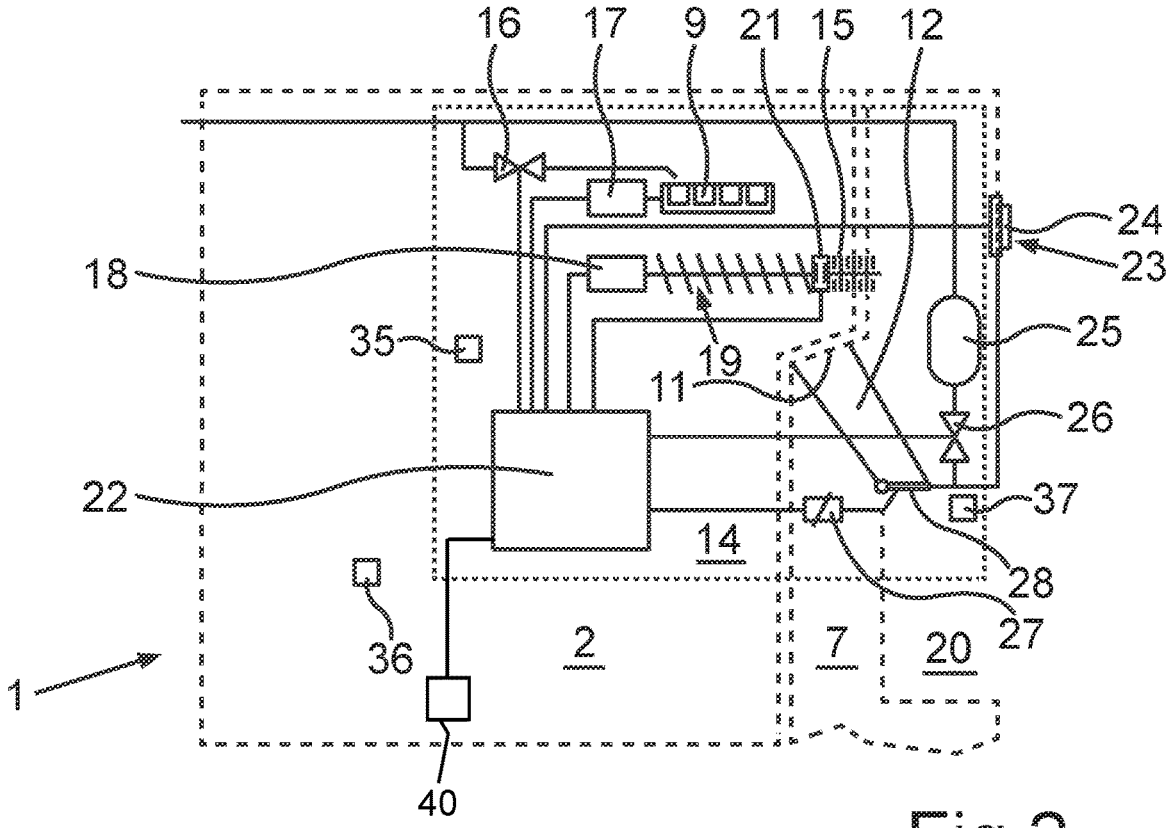
FIG. 2 is a schematic and block diagram of the domestic refrigeration appliance in accordance with FIG. 1.

FIG. 2 shows the domestic refrigeration appliance 1 in a schematic and block diagram, in which the respective components are shown as block images.

As can be seen in this diagram, the ice maker 9 is a mold container, the molds of which are able to be filled with water under the control of a magnetic valve 16 and which is able to be turned and have its molds released by an electric motor 17 in order to eject finished pieces of ice into the storage container or container 10. A further electric motor 18 is provided to drive a conveyor spiral 19, which is disposed in the floor of the container 10, in order to push pieces of ice to an ejection opening, namely the opening 11 and eject the pieces of ice through the dispensing chute 12.

As can be seen in FIG. 2, this dispensing chute 12 is disposed to open out into a dispenser recess 20 on the front side of the door 7.

The ice and/or water-dispensing device 14 also includes an adjustment facility 21 which in the exemplary embodiment, includes, or especially is, an electrically-controlled coupling. This adjustment facility 21 is able to be controlled with a control unit 22 and is thus adjustable.

The adjustment facility 21 is able to be coupled or is coupled to the medium creation facility 15, in order to adjust the latter independently of the control by the control unit 22.

The medium creation facility 15 especially includes a facility for crushing pieces of ice, which includes a plurality of rotatable blades. Depending on the position of the medium creation facility 15 set by the adjustment facility 21, the pieces of ice transported by the conveyor spiral 9 to the opening 11 are crushed and thus conveyed through by medium creation facility 15, or if a medium dispensing type of complete pieces of ice has been chosen by a user, they are conveyed past the medium creation facility 15 without being crushed.

In addition the domestic refrigeration appliance 1 includes an electronic input facility 24, which has a number of controls 23 that are able to be actuated by a user. Each control is embodied for selecting the dispensing of a specific type of medium of the medium to be dispensed and is thus embodied, depending on the embodiment of the ice and/or water-dispensing device 14, for selection of pieces of ice or of ice flakes or of water.

In the exemplary embodiment at least three controls are present, wherein by actuation of a first control, the type of dispensing to dispense pieces of ice, by actuation of a second control, the type of dispensing to dispense ice flakes and by actuation of a third control, the type of dispensing to dispense water is able to be selected.

In order to dispense water, provision can be made in this case for cooled water or also warm water to be dispensed. The ice and/or water-dispensing device 14 includes a water tank 25 for this purpose, which is connected to the same water line as the magnetic valve 16. A further magnetic valve 26 is provided between the water tank 25 and an outlet in the dispenser recess 20.

In addition, separate from the input facility 24 with the controls, the ice and/or water-dispensing device 14 includes a dispensing lever 27, which has an actuator. The dispensing lever 27 is likewise able to be actuated mechanically by a user, for example pushed backwards and/or rotated, and is connected to the control unit 22. By actuation of the dispensing lever 27 a flap 28, which delimits the dispensing chute 12 on the recess side, is opened or closed.

The control unit 22 is embodied so as to adjust the adjustment facility 21 as a function of a signal created by the actuation of a specific control of the input facility 24 and a specific type of dispensing associated therewith, before the actuation of the dispensing lever 27 to change the operational setting of the medium creation facility 15. The adjustment is made if the medium creation facility 15 coupled with the adjustment facility 21 is positioned in an operational setting different from the operational setting required for the selected specific type of dispensing of the medium.

The control unit 22 is especially embodied for control of the adjustment facility 21 so that, after the dispensing of the medium has ended and thus after the dispensing of pieces of ice or ice flakes or water, the position of the medium creation facility 15, once set, remains unchanged until the next user-initiated desired dispensing of a medium.

In an advantageous manner there is provision for the domestic refrigeration appliance 1 to have at least one sensor 35, which detects that the container is not present in its end position, and as a function thereof, for the medium creation facility 15 to be adjusted by the control unit 22 into an installation setting, in which putting the container 10 into its end position is not prevented by the medium creation facility 15. In particular the installation setting is that setting in which the medium creation facility 15 is positioned for the creation of ice flakes as the second type of medium.

In addition there is preferably provision for the control unit 22 to be embodied so as to activate a pump 36, to convey water as a third type of medium as a function of a signal created by the actuation of a specific control of the input facility 24 and a specific medium dispensing type associated therewith, before the actuation of the dispensing lever 27. In addition there is especially provision for the control unit 22 to be embodied so as to activate a light source 37 for illuminating the recess 20 surrounding the dispensing lever 27 as a function of a signal created by the actuation of a specific control of the input facility 24 and a specific dispensing type associated therewith, before the actuation of the dispensing lever 27.

In particular there is provision for the control unit 22 to be embodied so as to open a front-side cover not shown in FIG. 2 for covering the front side of the dispensing recess 20 as a function of a signal created by the actuation of a specific control of the input facility 24 and a specific dispensing type associated therewith, before the actuation of the dispensing lever.

The adjustment facility 21, as already mentioned, includes a drive motor 40, especially in the form of an electrically-driven coupling, with which the adjustment facility 14 and the medium creation facility 15 associated therewith are mechanically adjusted under motor-driven control, wherein this drive motor 40 is controlled by the control unit 22.

Figure 3:
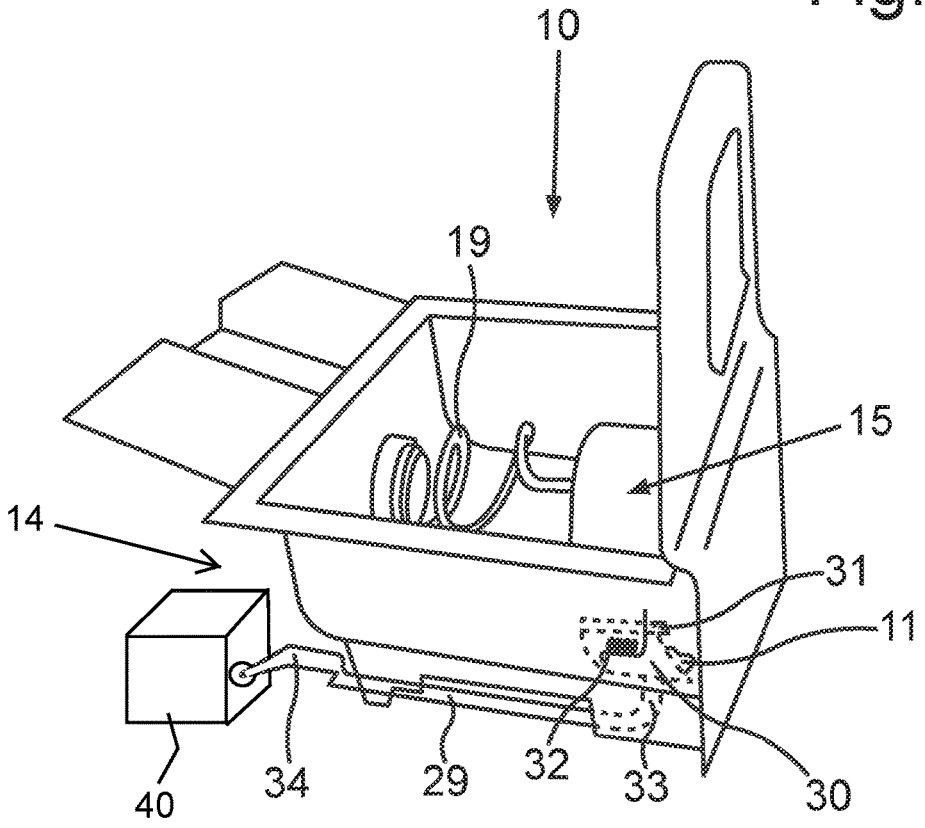
FIG. 3 is a perspective view of sub-components of the domestic appliance in accordance with FIG. 1 and FIG. 2.

In FIG. 3 the container 10 is shown in the removed state and in addition it is also shown in a perspective view. As can also be seen in FIG. 3, the ice and/or water-dispensing device 14 also includes an adjusting shaft 29 which is rotatably supported. A closure device 30 is actuated by using the adjusting shaft 29, wherein the closure device 30, in its closed position, closes off the opening 11 in the floor of the container 10. In order to hold this closure device 30, which can be embodied as a simple flap for example, in the closed position, the closure device 30 is supported for example by a hinge 31 in the container 10 and is pre-tensioned by a spring 32 into the closed position. The closure device 30 is connected to one end 33 of the adjusting shaft 29 in such a way that rotational movement of the adjusting shaft 29 causes an opening movement of the closure device 30. The adjusting shaft 29 has a lever 34 at its rear end and thus at the end lying opposite the end 33. This lever 34 is constructed to open and close the closure device 30, through which the medium creation facility 15 can also be adjusted between the possible operating modes and thus the individual medium dispensing types connected therewith can be adjusted. A coupling to the drive motor 40, especially the motor 40 of the adjustment facility 21, can then be provided in this case. The adjusting shaft 29 can then especially also be included in the adjustment facility 21.

The invention claimed is:

1. A domestic refrigeration appliance, comprising:

a medium creation facility having an operational setting;

a dispensing device for at least one of ice or water configured for dispensing non-crushed pieces of ice or ice flakes created from the pieces of ice by crushing or water created in the domestic refrigeration appliance, depending on said operational setting of said medium creation facility;

said dispensing device having a dispensing lever actuatable by a user and movable for starting dispensing of the pieces of ice or the ice flakes or water;

an adjustment facility for adjusting said operational setting of said medium creation facility;

said medium creation facility including an ice crushing facility to be adjusted to an individual location by said adjustment facility, depending on a dispensing request set by actuation of a specific control for pieces of ice as a first type of medium dispensed, or for ice flakes as a second type of medium dispensed;

an input facility having a plurality of controls to be actuated by a user, said controls each selecting a specific type of dispensing of the medium to be dispensed before an actuation of said dispensing lever;

a control unit for operating said adjustment facility, said control unit being configured to adjust said adjustment facility depending on a signal created by an actuation of a specific control and a specific medium dispensing type associated therewith, before said actuation of said dispensing lever to change said operational setting of said medium creation facility, if said medium creation facility coupled with said adjustment facility is positioned in an operational setting different from an operational setting required for a selected specific medium dispensing type;

said adjustment facility having a drive motor controlled by said control unit for mechanical adjustment of said adjustment facility and adjustment of said medium creation facility, said adjustment being actuated by said input facility and undertaken by said drive motor before actuation by said dispensing lever; and said dispensing device having an ice-receiving container being removable from the domestic refrigeration appliance, said medium creation facility being disposed in said container, said container having a lower region with an outlet opening for ice, a closure device biased into a closed position for closing said outlet opening, and an adjusting shaft of said adjustment facility at least partly disposed at said lower region for moving said closure device into an open position, said adjusting shaft being connected to said drive motor.

2. The domestic refrigeration appliance according to claim 1, wherein said control unit controls said adjustment facility in such a way that, once medium dispensing has ended, a set position of said medium creation facility remains unchanged until a next user-initiated medium dispensing.

3. The domestic refrigeration appliance according to claim 1, which further comprises an ice-making mold, said container being configured for receiving pieces of ice created in said ice-making mold.

4. The domestic refrigeration appliance according to claim 3, which further comprises:

at least one sensor recognizing that said container is not present in an end position;

said medium creation facility, as a function of said recognition that said container is not present in said end position, being adjustable by said control unit into an installation setting in which putting said container into said end position is unhindered by said medium creation facility.

5. The domestic refrigeration appliance according to claim 4, wherein said installation position is a position in which said medium creation facility is positioned for creation of ice flakes as the second type of medium dispensed.

6. The domestic refrigeration appliance according to claim 1, which further comprises:

a pump for conveying water as a third type of medium dispensed;

said control unit being configured to activate said pump for conveying the water as the third type of medium dispensed as a function of a signal created by an actuation of a specific control and a specific type of dispensing connected therewith, before said actuation of said dispensing lever.

7. The domestic refrigeration appliance according to claim 1, wherein said control unit is configured to activate a light source for illuminating a dispensing recess surrounding said dispensing lever as a function of a signal created by an actuation of a specific control and a specific type of dispensing connected therewith, before said actuation of said dispensing lever.

8. The domestic refrigeration appliance according to claim 1, which further comprises:

a cover for covering a front side of a dispensing recess surrounding said dispensing lever;

said control unit being configured to open said cover as a function of a signal created by an actuation of a specific control and a specific type of dispensing connected therewith, before said actuation of said dispensing lever.

9. The domestic refrigeration appliance according to claim 1, which further comprises:

a container for receiving ice created in the form of pieces of ice; and a conveyor shaft disposed in said container and being movable for conveying the pieces of ice to said outlet opening of said container;

said ice crushing facility being disposed adjacent said outlet opening, said ice crushing facility, depending on a medium dispensing type selected, being located in a dispensing path of the pieces of ice and crushing the pieces of ice into ice flakes or being disposed so that the pieces of ice are able to be conveyed past said ice crushing facility without being crushed.

10. A method for operating a domestic refrigeration appliance, the method comprising the following steps:

providing a medium creation facility having an operational setting;

dispensing uncrushed pieces of ice or ice flakes created from the pieces of ice by crushing or water created in the domestic refrigeration appliance by using a dispensing device for at least one of ice or water, depending on the operational setting of the medium creation facility;

starting the dispensing of the pieces of ice or the ice flakes or water by a user-initiated movement of a dispensing lever of the dispensing device;

adjusting the operational setting of the medium creation facility by using an adjustment facility having a drive motor;

using the adjustment facility to adjust an ice crushing facility of the medium creation facility to an individual location, depending on a dispensing request set by actuation of a specific control for pieces of ice as a first type of medium dispensed, or for ice flakes as a second type of medium dispensed;

selecting a specific type of dispensing of the medium to be dispensed before an actuation of the dispensing lever by actuation of a control of an input facility with a plurality of controls able to be actuated by a user;

operating the adjustment facility by using a control unit adjusting the adjustment facility as a function of a signal created by an actuation of a specific control and a specific type of dispensing connected therewith, before the actuation of the dispensing lever to change the operational setting of the medium creation facility, if the medium creation facility coupled to the adjustment facility is positioned upon actuation of a control to an operational setting different from an operational setting required for a selected specific type of dispensing;

using the control unit to control the drive motor of the adjustment facility for mechanical adjustment of the adjustment facility and adjustment of the medium creation facility, the adjustment being actuated by the input facility and undertaken by the drive motor before actuation by the dispensing lever;

providing the dispensing device with an ice-receiving container being removable from the domestic refrigeration appliance, the medium creation facility being disposed in the container, the container having a lower region with an outlet opening for ice, a closure device biased into a closed position for closing the outlet opening, and an adjusting shaft of the adjustment facility at least partly disposed at the lower region; and using the drive motor to actuate the adjusting shaft for moving the closure device into an open position.

11. The domestic refrigeration appliance according to claim 1, wherein said ice crushing facility is adjusted to said individual location by the adjustment facility depending on the dispensing request for pieces of ice as the first type of medium dispensed, or for ice flakes as the second type of medium dispensed, before said actuation of said dispensing lever to change said operational setting of said ice crushing facility.

12. The method according to claim 10, which further comprises carrying out the step of using the adjustment facility to adjust the ice crushing facility to the individual location depending on the dispensing request for pieces of ice as the first type of medium dispensed, or for ice flakes as the second type of medium dispensed, before the actuation of the dispensing lever to change the operational setting of the ice crushing facility.

* * * * *